US007665531B2

(12) United States Patent
Pietras

(10) Patent No.: US 7,665,531 B2
(45) Date of Patent: Feb. 23, 2010

(54) APPARATUS FOR FACILITATING THE CONNECTION OF TUBULARS USING A TOP DRIVE

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/600,314

(22) Filed: Nov. 15, 2006

(65) Prior Publication Data

US 2007/0074876 A1 Apr. 5, 2007

Related U.S. Application Data

(63) Continuation of application No. 11/129,734, filed on May 13, 2005, now Pat. No. 7,137,454, which is a continuation of application No. 10/967,387, filed on Oct. 18, 2004, now abandoned, which is a continuation of application No. 09/509,073, filed as application No. PCT/GB99/02203 on Jul. 22, 1999, now abandoned.

(30) Foreign Application Priority Data

Jul. 22, 1998 (GB) ..... 9815809.0
Aug. 24, 1998 (GB) ..... 9818358.5

(51) Int. Cl.
*E21B 31/20* (2006.01)
*E21B 19/18* (2006.01)
*B66C 1/42* (2006.01)

(52) U.S. Cl. ..... 166/380; 166/75.14; 166/77.52; 166/98; 166/383; 294/86.4; 294/93

(58) Field of Classification Search ..... 166/98, 166/77.4, 77.52, 85.5, 75.14, 379, 380, 382, 166/383, 385; 294/86.24, 86.25, 86.15, 93, 294/94, 96

See application file for complete search history.

(56) References Cited

U.S. PATENT DOCUMENTS

| | | | |
|---|---|---|---|
| 179,973 | A | 7/1876 | Thornton |
| 1,414,207 | A | 4/1922 | Reed |
| 1,418,766 | A | 6/1922 | Wilson |
| 1,454,194 | A | 5/1923 | Thomas |
| 1,585,069 | A | 5/1926 | Youle |

(Continued)

FOREIGN PATENT DOCUMENTS

CA 1 239 634 7/1988

(Continued)

OTHER PUBLICATIONS

"First Success with Casing-Drilling" Word Oil, Feb. 1999, pp. 25.

(Continued)

*Primary Examiner*—Jennifer H Gay
*Assistant Examiner*—Daniel P Stephenson
(74) *Attorney, Agent, or Firm*—Patterson & Sheridan, LLP

(57) ABSTRACT

A method and apparatus for facilitating the connection of tubulars using a top drive which, in one aspect, the apparatus includes a body connectable to said top drive. The body includes at least one gripping element radially displaceable by hydraulic or pneumatic fluid to drivingly engage a tubular to permit a screw connection between said tubular and a further tubular to be tightened to the required torque.

53 Claims, 4 Drawing Sheets

U.S. PATENT DOCUMENTS

| | | | | |
|---|---|---|---|---|
| 1,728,136 | A | | 9/1929 | Pedley |
| 1,777,592 | A | | 10/1930 | Thomas |
| 1,805,007 | A | | 5/1931 | Pedley |
| 1,825,026 | A | | 9/1931 | Thomas |
| 1,842,638 | A | | 1/1932 | Wigle |
| 1,844,379 | A | | 2/1932 | Campbell |
| 1,891,832 | A | | 12/1932 | Parks |
| 1,917,135 | A | * | 7/1933 | Littell ..... 294/86.15 |
| 2,105,885 | A | | 1/1938 | Hinderliter |
| 2,128,430 | A | | 8/1938 | Pryor |
| 2,167,338 | A | | 7/1939 | Murcell |
| 2,184,681 | A | | 12/1939 | Osmun at al. |
| 2,214,429 | A | | 9/1940 | Miller |
| 2,414,719 | A | | 1/1947 | Cloud |
| 2,488,107 | A | | 11/1949 | Abegg |
| 2,522,444 | A | | 9/1950 | Grable |
| 2,536,458 | A | | 1/1951 | Musinger |
| 2,570,080 | A | | 10/1951 | Stone |
| 2,582,987 | A | | 1/1952 | Hagenbook |
| 2,595,902 | A | | 5/1952 | Stone |
| 2,610,690 | A | | 9/1952 | Beatty |
| 2,622,916 | A | | 12/1952 | Libin et al. |
| 2,641,444 | A | | 6/1953 | Moon |
| 2,661,979 | A | | 12/1953 | Stone |
| 2,668,689 | A | | 2/1954 | Cormany |
| 2,692,059 | A | | 10/1954 | Bolling, Jr. |
| 2,712,932 | A | | 7/1955 | Gould |
| 2,953,406 | A | | 9/1960 | Young |
| 2,965,177 | A | | 12/1960 | Bus, Sr. et al. |
| 3,037,803 | A | | 6/1962 | Phillips |
| 3,041,901 | A | | 7/1962 | Knights |
| 3,087,546 | A | | 4/1963 | Wooley |
| 3,122,811 | A | | 3/1964 | Gilreath |
| 3,191,683 | A | | 6/1965 | Alexander |
| 3,193,116 | A | | 7/1965 | Kenneday et al. |
| 3,194,313 | A | | 7/1965 | Fanshawe |
| 3,266,582 | A | | 8/1966 | Homanick |
| 3,305,021 | A | | 2/1967 | Lebourg |
| 3,321,018 | A | | 5/1967 | McGill |
| 3,351,372 | A | | 11/1967 | Marks et al. |
| 3,380,528 | A | | 4/1968 | Timmons |
| 3,392,609 | A | | 7/1968 | Bartos |
| 3,477,527 | A | | 11/1969 | Koot |
| 3,489,220 | A | | 1/1970 | Kinley |
| 3,518,903 | A | | 7/1970 | Ham et al. |
| 3,548,936 | A | | 12/1970 | Kilgore et al. |
| 3,552,507 | A | | 1/1971 | Brown |
| 3,552,508 | A | | 1/1971 | Brown |
| 3,552,509 | A | | 1/1971 | Brown |
| 3,552,510 | A | | 1/1971 | Brown |
| 3,566,505 | A | | 3/1971 | Martin |
| 3,570,598 | A | | 3/1971 | Johnson |
| 3,602,302 | A | | 8/1971 | Kluth |
| 3,606,664 | A | | 9/1971 | Weiner |
| 3,635,105 | A | | 1/1972 | Dickmann et al. |
| 3,638,989 | A | | 2/1972 | Sandquist |
| 3,662,842 | A | | 5/1972 | Bromell |
| 3,680,412 | A | | 8/1972 | Mayer et al. |
| 3,691,825 | A | | 9/1972 | Dyer |
| 3,697,113 | A | | 10/1972 | Palauro et al. |
| 3,700,048 | A | | 10/1972 | Desmoulins |
| 3,706,347 | A | | 12/1972 | Brown |
| 3,746,330 | A | | 7/1973 | Taciuk |
| 3,747,675 | A | | 7/1973 | Brown |
| 3,766,991 | A | | 10/1973 | Brown |
| 3,776,320 | A | | 12/1973 | Brown |
| 3,780,883 | A | | 12/1973 | Brown |
| 3,808,916 | A | | 5/1974 | Porter et al. |
| 3,838,613 | A | | 10/1974 | Wilms |
| 3,840,128 | A | | 10/1974 | Swohoda, Jr. et al. |
| 3,848,684 | A | | 11/1974 | West |
| 3,857,450 | A | | 12/1974 | Guier |
| 3,871,618 | A | | 3/1975 | Funk |
| 3,881,375 | A | | 5/1975 | Kelly |
| 3,885,679 | A | | 5/1975 | Swoboda, Jr. et al. |
| 3,901,331 | A | | 8/1975 | Djurovic |
| 3,913,687 | A | | 10/1975 | Gyongyosi et al. |
| 3,915,244 | A | | 10/1975 | Brown |
| 3,961,399 | A | | 6/1976 | Boyadjieff |
| 3,964,552 | A | | 6/1976 | Slator |
| 3,980,143 | A | | 9/1976 | Swartz et al. |
| 4,054,332 | A | | 10/1977 | Bryan, Jr. |
| 4,077,525 | A | | 3/1978 | Callegari et al. |
| 4,100,968 | A | * | 7/1978 | Delano ..... 166/380 |
| 4,117,941 | A | | 10/1978 | McCleskey, Jr. et al. |
| 4,127,927 | A | | 12/1978 | Hauk et al. |
| 4,128,888 | A | | 12/1978 | Sheldon et al. |
| 4,142,739 | A | | 3/1979 | Billingsley |
| 4,202,225 | A | | 5/1980 | Sheldon et al. |
| 4,221,269 | A | | 9/1980 | Hudson |
| 4,257,442 | A | | 3/1981 | Claycomb |
| 4,262,693 | A | | 4/1981 | Giebeler |
| 4,274,777 | A | | 6/1981 | Scaggs |
| 4,274,778 | A | | 6/1981 | Putnam et al. |
| 4,280,380 | A | | 7/1981 | Eshghy |
| 4,315,553 | A | | 2/1982 | Stallings |
| 4,320,915 | A | | 3/1982 | Abbott et al. |
| 4,401,000 | A | | 8/1983 | Kinzbach |
| 4,421,179 | A | | 12/1983 | Boyadjieff |
| 4,437,363 | A | | 3/1984 | Haynes |
| 4,440,220 | A | | 4/1984 | McArthur |
| 4,446,745 | A | | 5/1984 | Stone et al. |
| 4,449,596 | A | | 5/1984 | Boyadjieff |
| 4,472,002 | A | | 9/1984 | Beney et al. |
| 4,489,794 | A | | 12/1984 | Boyadjieff |
| 4,492,134 | A | | 1/1985 | Reinholdt et al. |
| 4,494,424 | A | | 1/1985 | Bates |
| 4,515,045 | A | | 5/1985 | Gnatchenko et al. |
| 4,529,045 | A | | 7/1985 | Boyadjieff et al. |
| 4,570,706 | A | | 2/1986 | Pugnet |
| 4,582,133 | A | | 4/1986 | Tambs |
| 4,592,125 | A | | 6/1986 | Skene |
| 4,593,584 | A | | 6/1986 | Neves |
| 4,593,773 | A | | 6/1986 | Skeie |
| 4,604,724 | A | | 8/1986 | Shaginian et al. |
| 4,604,818 | A | | 8/1986 | Inoue |
| 4,605,077 | A | * | 8/1986 | Boyadjieff ..... 175/85 |
| 4,610,315 | A | | 9/1986 | Koga et al. |
| 4,613,161 | A | | 9/1986 | Brisco |
| 4,621,974 | A | | 11/1986 | Krueger |
| 4,625,796 | A | | 12/1986 | Boyadjieff |
| 4,646,827 | A | | 3/1987 | Cobb |
| 4,649,777 | A | | 3/1987 | Buck |
| 4,652,195 | A | | 3/1987 | McArthur |
| 4,667,752 | A | | 5/1987 | Berry et al. |
| 4,676,312 | A | | 6/1987 | Mosing et al. |
| 4,681,158 | A | | 7/1987 | Pennison |
| 4,681,162 | A | | 7/1987 | Boyd |
| 4,683,962 | A | | 8/1987 | True |
| 4,686,873 | A | | 8/1987 | Lang et al. |
| 4,709,599 | A | | 12/1987 | Buck |
| 4,709,766 | A | | 12/1987 | Boyadjieff |
| 4,725,179 | A | | 2/1988 | Woolslayer et al. |
| 4,735,270 | A | | 4/1988 | Fenyvesi |
| 4,738,145 | A | | 4/1988 | Vincent et al. |
| 4,742,876 | A | | 5/1988 | Barthelemy et al. |
| 4,753,300 | A | | 6/1988 | Shaw et al. |
| 4,759,239 | A | | 7/1988 | Hamilton et al. |
| 4,762,187 | A | | 8/1988 | Haney |
| 4,765,401 | A | | 8/1988 | Boyadjieff |
| 4,765,416 | A | | 8/1988 | Bjerking et al. |
| 4,773,689 | A | | 9/1988 | Wolters |
| 4,781,359 | A | | 11/1988 | Matus |
| 4,791,997 | A | | 12/1988 | Krasnov |

4,793,422 A 12/1988 Krasnov
4,800,968 A 1/1989 Shaw et al.
4,813,493 A 3/1989 Shaw et al.
4,813,495 A 3/1989 Leach
4,813,498 A 3/1989 Lynch et al.
4,821,814 A 4/1989 Willis et al.
4,832,552 A 5/1989 Skelly
4,836,064 A 6/1989 Slator
4,843,945 A 7/1989 Dinsdale
4,867,236 A 9/1989 Haney et al.
4,875,530 A 10/1989 Frink et al.
4,878,546 A 11/1989 Shaw et al.
4,899,816 A 2/1990 Mine
4,909,741 A 3/1990 Schasteen et al.
4,921,386 A 5/1990 McArthur
4,936,382 A 6/1990 Thomas
4,962,579 A 10/1990 Moyer et al.
4,962,819 A 10/1990 Bailey et al.
4,971,146 A 11/1990 Terrell
4,997,042 A 3/1991 Jordan et al.
5,022,472 A 6/1991 Bailey et al.
5,036,927 A 8/1991 Willis
5,049,020 A 9/1991 McArthur
5,060,542 A 10/1991 Hauk
5,062,756 A 11/1991 McArthur et al.
5,107,940 A 4/1992 Berry
5,111,893 A 5/1992 Kvello-Aune
RE34,063 E 9/1992 Vincent et al.
5,191,939 A 3/1993 Stokley
5,207,128 A 5/1993 Albright
5,233,742 A 8/1993 Gray et al.
5,245,265 A 9/1993 Clay
5,251,709 A 10/1993 Richardson
5,255,751 A 10/1993 Stogner
5,272,925 A 12/1993 Henneuse et al.
5,282,653 A 2/1994 LaFleur et al.
5,284,210 A 2/1994 Helms et al.
5,294,228 A 3/1994 Willis et al.
5,297,833 A 3/1994 Willis et al.
5,305,839 A 4/1994 Kalsi et al.
5,332,043 A 7/1994 Ferguson
5,340,182 A 8/1994 Busink et al.
5,351,767 A 10/1994 Stogner et al.
5,354,150 A 10/1994 Canales
5,368,113 A 11/1994 Schulze-Beckinghausen
5,386,746 A 2/1995 Hauk
5,388,651 A 2/1995 Berry
5,433,279 A 7/1995 Tassari et al.
5,461,905 A 10/1995 Penisson
5,497,840 A 3/1996 Hudson
5,501,280 A 3/1996 Brisco
5,501,286 A 3/1996 Berry
5,503,234 A 4/1996 Clanton
5,535,824 A 7/1996 Hudson
5,575,344 A 11/1996 Wireman
5,577,566 A 11/1996 Albright et al.
5,584,343 A 12/1996 Coone
5,588,916 A 12/1996 Moore
5,645,131 A 7/1997 Trevisani
5,661,888 A 9/1997 Hanslik
5,664,310 A 9/1997 Penisson
5,667,026 A 9/1997 Lorenz et al.
5,706,894 A 1/1998 Hawkins, III
5,711,382 A 1/1998 Hansen et al.
5,735,348 A 4/1998 Hawkins, III
5,735,351 A 4/1998 Helms
5,746,276 A 5/1998 Stuart
5,765,638 A 6/1998 Taylor
5,772,514 A 6/1998 Moore
5,785,132 A 7/1998 Richardson et al.
5,791,410 A 8/1998 Castille et al.
5,803,191 A 9/1998 Mackintosh
5,806,589 A 9/1998 Lang
5,833,002 A 11/1998 Holcombe
5,836,395 A 11/1998 Budde
5,839,330 A 11/1998 Stokka
5,842,530 A 12/1998 Smith et al.
5,850,877 A 12/1998 Albright et al.
5,890,549 A 4/1999 Sprehe
5,909,768 A 6/1999 Castille et al.
5,931,231 A 8/1999 Mock
5,960,881 A 10/1999 Allamon et al.
5,971,079 A * 10/1999 Mullins ..... 166/387
5,971,086 A 10/1999 Bee et al.
6,000,472 A * 12/1999 Albright et al. ..... 166/380
6,012,529 A 1/2000 Mikolajczyk et al.
6,056,060 A 5/2000 Abrahamsen et al.
6,065,550 A 5/2000 Gardes
6,070,500 A 6/2000 Dlask et al.
6,079,509 A 6/2000 Bee et al.
6,119,772 A 9/2000 Pruet
6,142,545 A 11/2000 Penman et al.
6,161,617 A 12/2000 Gjedebo
6,170,573 B1 1/2001 Brunet et al.
6,173,777 B1 1/2001 Mullins
6,199,641 B1 3/2001 Downie et al.
6,202,764 B1 3/2001 Ables et al.
6,217,258 B1 4/2001 Yamamoto et al.
6,227,587 B1 5/2001 Terral
6,237,684 B1 5/2001 Bouligny, Jr. et al.
6,276,450 B1 8/2001 Seneviratne
6,279,654 B1 8/2001 Mosing et al.
6,309,002 B1 * 10/2001 Bouligny ..... 294/86.25
6,311,792 B1 11/2001 Scott et al.
6,315,051 B1 11/2001 Ayling
6,334,376 B1 1/2002 Torres
6,349,764 B1 2/2002 Adams et al.
6,360,633 B2 3/2002 Pietras
6,378,630 B1 4/2002 Ritorto et al.
6,390,190 B2 5/2002 Mullins
6,412,554 B1 7/2002 Allen et al.
6,415,862 B1 7/2002 Mullins
6,431,626 B1 8/2002 Bouligny
6,443,241 B1 9/2002 Juhasz et al.
6,527,047 B1 3/2003 Pietras
6,527,493 B1 3/2003 Kamphorst et al.
6,536,520 B1 3/2003 Snider et al.
6,553,825 B1 4/2003 Boyd
6,591,471 B1 7/2003 Hollingsworth et al.
6,595,288 B2 7/2003 Mosing et al.
6,622,796 B1 9/2003 Pietras
6,637,526 B2 10/2003 Juhasz et al.
6,651,737 B2 11/2003 Bouligny
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,725,938 B1 4/2004 Pietras
6,725,949 B2 4/2004 Seneviratne
6,732,822 B2 5/2004 Slack et al.
6,742,584 B1 * 6/2004 Appleton ..... 166/98
6,742,596 B2 * 6/2004 Haugen ..... 166/380
6,832,656 B2 12/2004 Cameron et al.
6,832,658 B2 12/2004 Keast
6,840,322 B2 1/2005 Haynes
6,892,835 B2 5/2005 Shahin et al.
6,907,934 B2 6/2005 Kauffman et al.
6,938,697 B2 9/2005 Haugen
6,976,298 B1 12/2005 Pietras
7,028,586 B2 4/2006 Robichaux
7,073,598 B2 7/2006 Haugen
7,096,977 B2 8/2006 Juhasz et al.
7,100,698 B2 9/2006 Kracik et al.
7,107,875 B2 9/2006 Haugen et al.

| | | | | |
|---|---|---|---|---|
| 7,117,938 | B2 | 10/2006 | Hamilton et al. | |
| 7,140,445 | B2 | 11/2006 | Shahin et al. | |
| 7,213,656 | B2 | 5/2007 | Pietras | |
| 7,325,610 | B2 | 2/2008 | Giroux et al. | |
| 2001/0042625 | A1 | 11/2001 | Appleton | |
| 2002/0029878 | A1 | 3/2002 | Victor | |
| 2002/0108748 | A1 | 8/2002 | Keyes | |
| 2002/0170720 | A1* | 11/2002 | Haugen | 166/379 |
| 2003/0155159 | A1 | 8/2003 | Slack et al. | |
| 2003/0164276 | A1 | 9/2003 | Snider et al. | |
| 2003/0173073 | A1 | 9/2003 | Snider et al. | |
| 2003/0221519 | A1 | 12/2003 | Haugen et al. | |
| 2004/0003490 | A1 | 1/2004 | Shahin et al. | |
| 2004/0011531 | A1* | 1/2004 | Pietras | 166/379 |
| 2004/0069500 | A1* | 4/2004 | Haugen | 166/380 |
| 2004/0144547 | A1 | 7/2004 | Koithan et al. | |
| 2004/0173357 | A1* | 9/2004 | Pietras | 166/380 |
| 2004/0173358 | A1 | 9/2004 | Haugen et al. | |
| 2004/0216924 | A1 | 11/2004 | Pietras et al. | |
| 2004/0251050 | A1 | 12/2004 | Shahin et al. | |
| 2004/0251055 | A1 | 12/2004 | Shahin et al. | |
| 2005/0000691 | A1 | 1/2005 | Giroux et al. | |
| 2005/0051343 | A1 | 3/2005 | Pietras et al. | |
| 2005/0096846 | A1 | 5/2005 | Koithan et al. | |
| 2005/0098352 | A1 | 5/2005 | Beierbach et al. | |
| 2005/0269104 | A1* | 12/2005 | Folk et al. | 166/379 |
| 2006/0000600 | A1 | 1/2006 | Pietras | |
| 2006/0124353 | A1 | 6/2006 | Juhasz et al. | |
| 2006/0180315 | A1 | 8/2006 | Shahin et al. | |
| 2007/0000668 | A1 | 1/2007 | Christensen | |

FOREIGN PATENT DOCUMENTS

| | | | |
|---|---|---|---|
| CA | 2 307 386 | | 11/2000 |
| EP | 0 087 373 | | 8/1983 |
| EP | 0 162 000 | | 11/1985 |
| EP | 0 171 144 | | 2/1986 |
| EP | 0 202 184 | | 11/1986 |
| EP | 0 285 386 | | 10/1988 |
| EP | 0 474 481 | | 3/1992 |
| EP | 0 479 583 | | 4/1992 |
| EP | 0 525 247 | | 2/1993 |
| EP | 0 589 823 | | 3/1994 |
| EP | 1148208 | | 10/2001 |
| EP | 1 256 691 | | 11/2002 |
| GB | 1 469 661 | | 4/1977 |
| GB | 2 053 088 | | 2/1981 |
| GB | 2 201 912 | | 9/1988 |
| GB | 2 223 253 | | 4/1990 |
| GB | 2 224 481 | | 9/1990 |
| GB | 2 240 799 | | 8/1991 |
| GB | 2 275 486 | | 4/1993 |
| GB | 2 345 074 | | 6/2000 |
| GB | 2 357 530 | | 6/2001 |
| JP | 2001/173349 | | 6/2001 |
| WO | WO 90-06418 | | 6/1990 |
| WO | WO 92-18743 | | 10/1992 |
| WO | WO 93-07358 | | 4/1993 |
| WO | WO 95-10686 | | 4/1995 |
| WO | WO 96-18799 | | 6/1996 |
| WO | WO 97-08418 | | 3/1997 |
| WO | WO 98-05844 | | 2/1998 |
| WO | WO 98-11322 | | 3/1998 |
| WO | WO 9811322 | A1 * | 3/1998 |
| WO | WO 98-32948 | | 7/1998 |
| WO | WO 99-11902 | | 3/1999 |
| WO | WO 99-41485 | | 8/1999 |
| WO | WO 99-58810 | | 11/1999 |
| WO | WO 00-08293 | | 2/2000 |
| WO | WO 00-09853 | | 2/2000 |
| WO | WO 00-11309 | | 3/2000 |
| WO | WO 00-11310 | | 3/2000 |
| WO | WO 00-11311 | | 3/2000 |
| WO | WO 00-39429 | | 7/2000 |
| WO | WO 00-39430 | | 7/2000 |
| WO | WO 00-50730 | | 8/2000 |
| WO | WO 01-12946 | | 2/2001 |
| WO | WO 01-33033 | | 5/2001 |
| WO | WO 01-94738 | | 12/2001 |
| WO | WO 2004-022903 | | 3/2004 |
| WO | WO 2005/090740 | | 9/2005 |

OTHER PUBLICATIONS

Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.

Laurent, et al., "Hydraulic Rig Supports Casing Drilling," World Oil, Sep. 1999, pp. 61-68.

Shepard, et al., "Casing Drilling: An Emerging Technology," IADC/SPE Paper 67731, SPE/IADC Drilling Conference, Feb. 27-Mar. 1, 2001, pp. 1-13.

Warren, et al., "Casing Drilling Technology Moves To More Challenging Application," AADE Paper 01-NC-HO-32, AADE National Drilling Conference, Mar. 27-29, 2001, pp. 1-10.

Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.

Vincent, et al., "Liner And Casing Drilling—Case Histories And Technology," Paper WOCD-0307-02, World Oil Casing Drilling Technical Conference, Mar. 6-7, 2003, pp. 1-20.

Tessari, et al., "Retrievable Tools Provide Flexibility for Casing Drilling," Paper No. WOCD-0306-01, World Oil Casing Drilling Technical Conference, 2003, pp. 1-11.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving the Marked?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive. Powerful Hydraulic Compact Top Drive Drilling System. TESCO Drilling Technology, Apr. 1998, 2 Pages.

Product Information (Sections 1-10) CANRIG Drilling Technology, Ltd., Sep. 18, 1996.

Coiled Tubing Handbook, World Oil, Gulf Publishing Company. 1993.

Bickford L Dennis and Mark J. Mabile, Casing Drilling Rig Selection For Stratton Field, Texas, World Oil. vol. 226, No. 3, Mar. 2005.

G H. Kamphorst, G. L. Van Wechem, W. Boom, D. Bottger, and K. Koch, Casing Running Tool, SPE/IADC 52770.

* cited by examiner

APPARATUS FOR FACILITATING THE CONNECTION OF TUBULARS USING A TOP DRIVE

CROSS REFERENCE TO RELATED APPLICATIONS

This application is a continuation of U.S. patent application Ser. No. 11/129,734, filed on May 13, 2005, now U.S. Pat. No. 7,137,454; which is a continuation of U.S. patent application Ser. No. 10/967,387, filed on Oct. 18, 2004, now abandoned; which is a continuation of U.S. patent application Ser. No. 09/509,073, filed on Aug. 22, 2000, now abandoned; which is the National Stage of International Application No. PCT/GB99/02203, filed on Jul. 22, 1999; which claims priority to GB 9815809.0, filed on Jul. 22, 1998 and claims priority to GB 9818358.5, filed on Aug. 24, 1998. All of the above referenced patent applications are herein incorporated by reference in their entirety.

BACKGROUND OF THE INVENTION

1. Field of the Invention

This invention relates to an apparatus for facilitating the connection of tubulars using a top drive and is more particularly, but not exclusively, intended for facilitating the connection of a section or stand of casing to a string of casing.

2. Description of the Related Art

In the construction of oil or gas wells it is usually necessary to line the borehole with a string of tubulars known as casing. Because of the length of the casing required, sections or stands of say two sections of casing are progressively added to the string as it is lowered into the well from a drilling platform. In particular, when it is desired to add a section or stand of casing the string is usually restrained from falling into the well by applying the slips of a spider located in the floor of the drilling platform. The new section or stand of casing is then moved from a rack to the well center above the spider. The threaded pin of the section or stand of casing to be connected is then located over the threaded box of the casing in the well and the connection is made up by rotation therebetween. An elevator is then connected to the top of the new section or stand and the whole casing string lifted slightly to enable the slips of the spider to be released. The whole casing string is then lowered until the top of the section is adjacent the spider whereupon the slips of the spider are re-applied, the elevator disconnected and the process repeated.

It is common practice to use a power tong to torque the connection up to a predetermined torque in order to make the connection. The power tong is located on the platform, either on rails, or hung from a derrick on a chain. However, it has recently been proposed to use a top drive for making such connection. A "top drive" is a top driven rotational system substantially used for drilling purposes, assigned to the draw-works at a higher level than the elevator, as is previously known.

Because of the high costs associated with the construction of oil and gas wells time is critical and it has been observed by the applicants that the time to connect a tubular to a top drive using existing equipment could be reduced.

SUMMARY OF THE INVENTION

Accordingly there is provided an apparatus for facilitating the connection of tubulars using a top drive, which apparatus comprises a body connectable to said top drive, said body comprising at least one gripping element radially displaceable by hydraulic or pneumatic fluid to drivingly engage a tubular to permit a screw connection between said tubular and a further tubular to be tightened to the required torque.

The present invention also provides an apparatus for facilitating the connection of tubulars using a top drive, said apparatus comprising a body connectable to said top drive, said body comprising at least one gripping element radially displaceable to drivingly engage said tubular and a sealing packer to inhibit, in use, fluid in said tubular from escaping therefrom. Preferably, said sealing packer can be actuated by hydraulic or pneumatic fluid.

One advantage of at least preferred embodiments of the invention is that the gripping elements transfer the full torque capacity of the top drive to the casing without damaging the pipe surface. Elastomeric jaws greatly reduce the marks made by the dies as compared to simple metal dies. Elastomeric jaws also enable pipes with differing inside diameters to be clamped with only one set of jaws.

The present invention also provides an apparatus for running tubulars into a borehole, said apparatus comprising a body provided with a wedge lock assembly and a hydraulically operable grapple to mechanically grip the inside wall of a tubular to be run into, or withdrawn from, the borehole, said grapple incorporating positive locking means to prevent inadvertent release of said grapple, said body further comprising means to prevent spillage of drilling fluid when the body is withdrawn from the tubular, a sealing packer for engagement with the tubular to permit fluid to be circulated within the tubular, and a stabbing guide.

In use, such an apparatus may be connected to a top-drive unit via a threaded connection, or to a Kelly driven rig via a pump joint latched into an elevator. Both systems have available a means of connecting up to a circulating system that will permit the casing to be filled or circulated at any time during the running operation.

Casing is normally run by picking up a joint at a time, utilizing single pickup elevators to bring the joint into the derrick and connect it to the previously run joint, whether it be by threaded connection or "mechanical latching or locking". The two joints are either screwed or locked together and then lowered into the well bore using elevators.

With heavy casing strings it is required that very large elevators are used to be able to handle the load. This often means that the top of the casing joint must be set 8-10 feet above the rig floor to permit disengagement to take place. Scaffolding is often required for the rig crews to be able to stab or connect the next joint to the string. It is also normal to either utilize a separate pack-off assembly, or a fillup hose that must be installed by the rig crew after it has been lowered and set in the slips.

Preferred embodiments of the present invention will permit the casing to be picked up by single pickup elevators, connected either by rotation or mechanical latch, and then the casing running tool to be "stabbed" into the bore of the top joint without damage, due to the rubber bull-nose guide 216. When the tool is at the correct depth of penetration within the casing bore, the hydraulic piston is actuated to drive the grapple down onto the wedge lock and secure the grapple to the casing wall. As the casing string is lifted, the wedge-lock continues to drive into the grapple bore, providing an ever increasing wedge lock. The compression spring installed within the hydraulic piston provides a "positive-lock" or fail-safe should the hydraulic system fail for any reason.

When the apparatus is engaged, it is then possible to push, pull, or even rotate the casing string. A seal ring assembly is required to rotate the casing string to permit constant control of the hydraulic actuating piston to be maintained.

Preferred embodiments of the apparatus are equipped with a through-bore to permit casing fillup and circulation to take place at any time. There may also be provided a pack-off that can be either inflatable or flow pressure operated.

The present invention also provides a top drive having an apparatus in accordance with the present invention attached thereto.

BRIEF DESCRIPTION OF THE DRAWINGS

Some preferred embodiments of the invention will now be described by way of example only, with reference to the accompanying drawings, in which.

DETAILED DESCRIPTION OF THE PREFERRED EMBODIMENT

Figure 1:
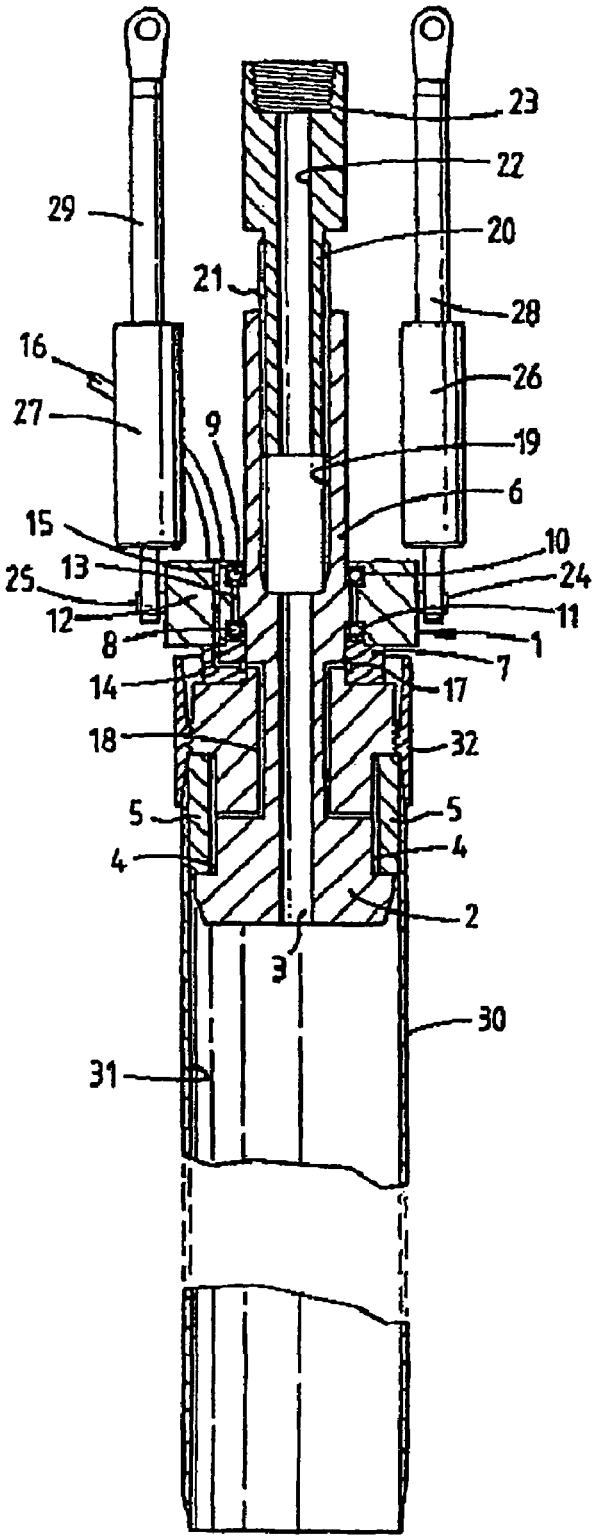
FIG. 1 is a cross-sectional side view of a first embodiment of an apparatus in accordance with the present invention inserted in a section of casing.

Referring to FIG. 1 there is shown an apparatus which is generally identified by reference numeral 1. The apparatus 1 comprises a cylindrical body 2 which has a central passage 3 therethrough. The cylindrical body 2 has circumferentially spaced recesses 4 thereabout in which respective gripping elements 5 are located.

The upper part 6 of the cylindrical body 2 is of a reduced outer diameter. The upper part 6 passes through a rotary transmission 7 and is rotatably supported by two bearings 8, 9 which are arranged in corresponding channels 10, 11 in an annular support 12. A circumferentially raised portion 13 between the two bearings 8, 9 is provided in the upper part 6 to inhibit longitudinal movement of the cylindrical body 2.

The rotary transmission 7 is mounted fast on the annular support 12 and is in sealing tight relation with the upper part 6 which is rotatable relative thereto. The rotary transmission 7 is provided with a feed passage 15 in the annular support 12 and with a feed line 16. One end of a feed passage 14 is in fluid communication with the feed passage 15 and the other end of the feed passage 14 is in fluid communication with a radial channel 17. Feed passages 18 are provided in the cylindrical body 2 to link the radial channel 17 with the circumferential recesses 4 behind each gripping element.

The upper part 6 is provided with internal splines 19 along the upper part of the passage 3. The lower end of a connecting member 20 is provided with corresponding external splines and is located in the upper part of the passage 3. The upper end of the connecting member 20 is provided with a circulating canal 22 and threads 23 for connection to a top drive (FIG. 2).

Figure 2:
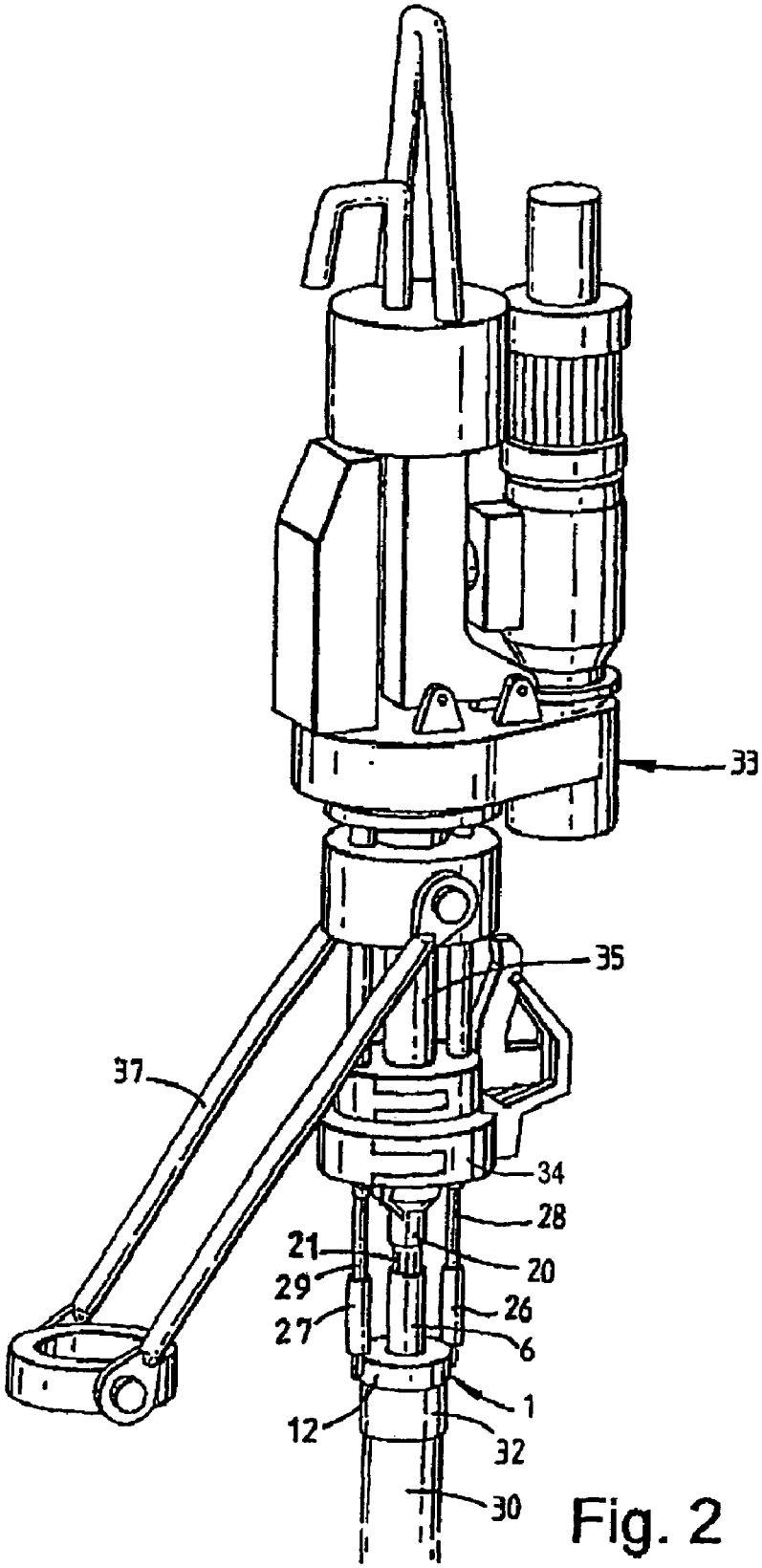
FIG. 2 shows the apparatus of FIG. 1 connected to a top drive and inserted in a section of casing.

The support member 12 is provided with two axles 24, 25 to which compensating cylinders 26, 27 are attached, the corresponding pistons 28, 29 being, in use, connected to the body of the top drive (FIG. 2).

Gripping elements 5 are preferably based on the construction described in PCT Publication No. WO 94/05894 which is incorporated herein for all purposes, and sold by the applicants under the trade mark "MICRO-GRIP".

The gripping elements 5 comprise a plurality of longitudinally extending strips (not shown) which are embedded side by side in an elastomeric base member (not shown). Each strip projects out from said elastomeric base member, and each strip has a pipe gripping edge (not shown) facing away from the elastomeric base member, so that channels are formed between adjacent strips to accommodate debris from the surface of the casing to be gripped. The pipe gripping edge may, for example, comprise teeth, so that the strips resemble saw blades, or may comprise particulate material bonded to the strips. This type of gripping element allows rotational torque to be applied to the tubular and longitudinal forces produced by circulating fluid within the tubular and the weight of the tubular to be taken.

The cylindrical body 2 is shown in FIG. 1 in a section of casing 30 with gripping elements 5 in a radially extended position, engaging the inner wall 31 of the section of casing 30 beneath a threaded box 32.

In use, the pistons 28, 29 are connected to the stator 34 of the top drive 33 (FIG. 2). The rotor 35 of the top drive 33 is connected to the connecting member 20. The section of casing 30 is positioned over the upper portion of a casing string using, for example, a pipe positioning device. The top drive 33 with the attached apparatus 1 is lowered so that the cylindrical body 2 thereof enters the casing 30. Alternatively, the section or stand of casing may be brought towards the apparatus 1 using the methods and apparatus disclosed in co-pending UK Patent Application No. 9818366.8 entitled "Methods and Apparatus for Facilitating the Connection of Tubulars Using a Top Drive" filed by the applicant for the present application on 24 Aug. 1998. If the support member 12 hits the top of the threaded box 32, the compensating cylinders 26, 27, which contain compressed air, cushion the impact whilst the splines 19, 21 in the upper part 6 of the cylindrical body 2 will allow relative longitudinal movement between the apparatus 1 and the top drive 33 whilst being able to transmit rotation therebetween.

Hydraulic pressure is applied through feed line 16, feed passage 15, feed passage 14, radial channel 17, and feed passage 18 into recess 4 behind gripping elements 5, forcing the gripping elements 5 radially outwardly to engage the inner wall 31 of the casing 30.

The top drive 33 may now be used to rotate the rotor 35 which in turn rotates the connecting member 20, the cylindrical body 2 and hence the casing 30. The compensating cylinders 26, 27 will allow a small downward movement as the threaded pin on the bottom of the casing enters the box on the top of the string, and may be controlled remotely. The compensating cylinders 26, 27 may be of the pneumatic compensating type, i.e. their internal pressure may be adjusted to compensate for the weight of the casing 30 so that movement of the tubular may be conducted with minimal force. Pneumatic compensating cylinders also reduce the risk of damage to the threads of the tubulars. This can conveniently be achieved by introducing pneumatic fluid into the cylinders 26, 27 and adjusting the pressure therein. Hydraulic cylinders may, however, be used or hydraulic cylinders provided with a pneumatic bellows system.

Once the joint is correctly tightened the elevator 37 is swung into position and the elevator slips therein (not shown) are actuated to grip the casing 30 beneath the box 32. The top drive 33 is then raised a small amount using the drawworks to enable the slips in the spider to be released and the top drive and casing string is then lowered.

As the casing is lowered liquid may be introduced into the casing 30 via the connecting canal 22 and the central passage 3. The introduction of such liquid is often desirable to facilitate the lowering of the casing.

Figure 3:
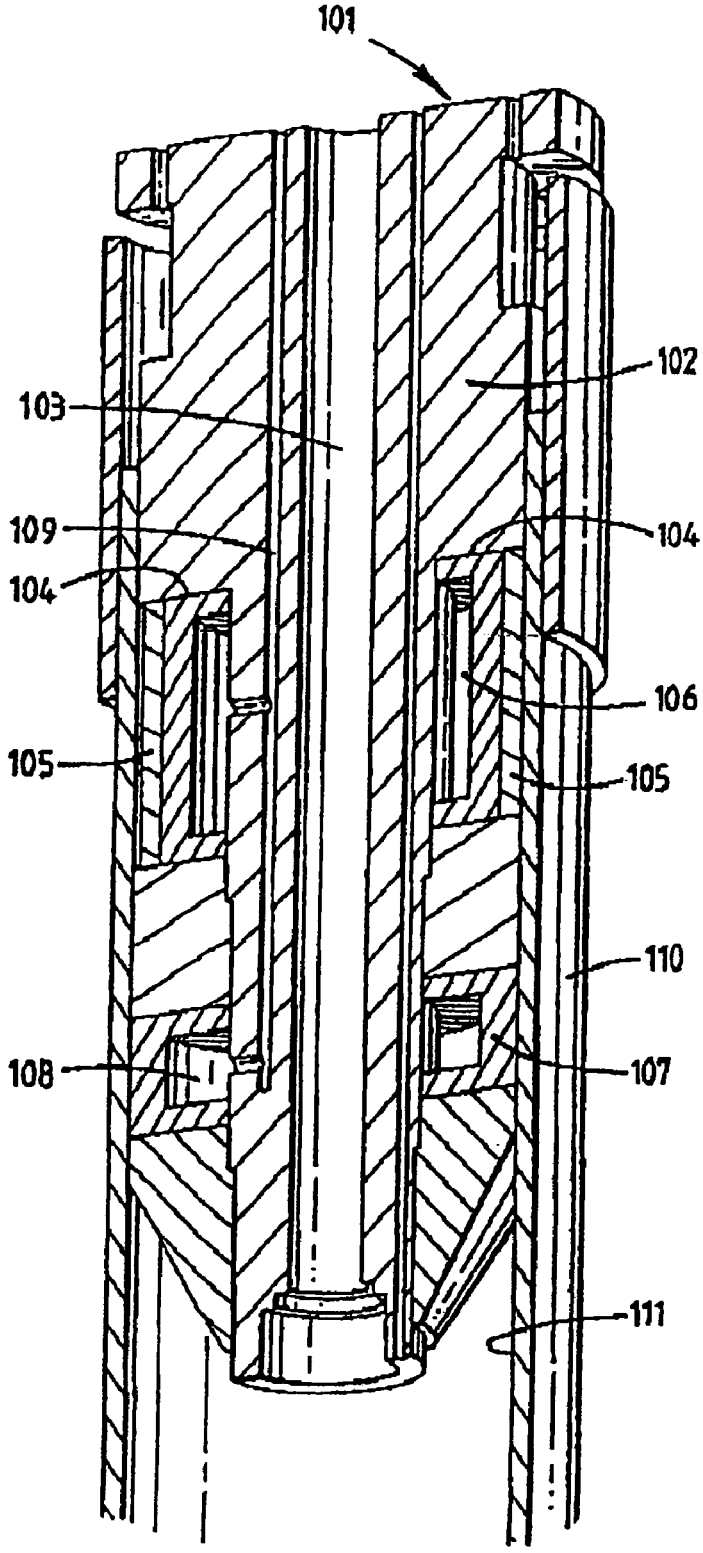
FIG. 3 shows a cross-sectional side view in perspective of part of a second embodiment of an apparatus in accordance with the present invention.

Referring to FIG. 3 there is shown an apparatus in accordance with a second embodiment of the present invention which is generally identified by the reference numeral 101.

The apparatus 101 is generally similar to that of FIG. 1, in that it comprises a cylindrical body 102 which has a central passage 103 therethrough. The cylindrical body 102 has recesses 104 thereabout in which gripping elements 105 are located. The gripping elements 105 are provided with recesses 106.

The cylindrical body 102 is also provided with a cylindrical sealing packer 107 arranged below the gripping elements 105. The cylindrical sealing packer 107 is provided with a recess 108. The cylindrical sealing packer 107 which is made from an elastomeric material is fast with the cylindrical body 102.

The cylindrical body 102 is provided with a feed passage 109 which is at the upper end connected to a hydraulic fluid supply, and at the other, to the recesses 106 and 108 in the gripping elements 105 and the cylindrical sealing packer 107 respectively.

In use, the apparatus 101 is connected to a top drive, such as that shown in FIG. 2, and is inserted into the top of a section or stand of casing 110. Hydraulic fluid pressure is applied through feed passage 109 into recesses 106 and 108 which moves the gripping elements 105 into engagement with the inner wall 111 and the cylindrical sealing packer 107 into contact with the inner wall 111. The gripping elements 105 engage with the inner wall 111 of the casing 110 so that rotational force can be transmitted from the apparatus 101 to the casing 110. The sealing packer 107 substantially prevents any fluids such as mud from escaping between the apparatus 101 end the casing 110. This is particularly advantageous where it is desired to circulate fluid to facilitate running the casing. In particular, if the casing string becomes lodged on an obstruction, liquid can be pumped down the casing string under high pressure to remove the obstruction. The sealing packer 107 facilitates this operation by inhibiting liquid under high pressure escaping through the top of the casing 30.

Figure 4:
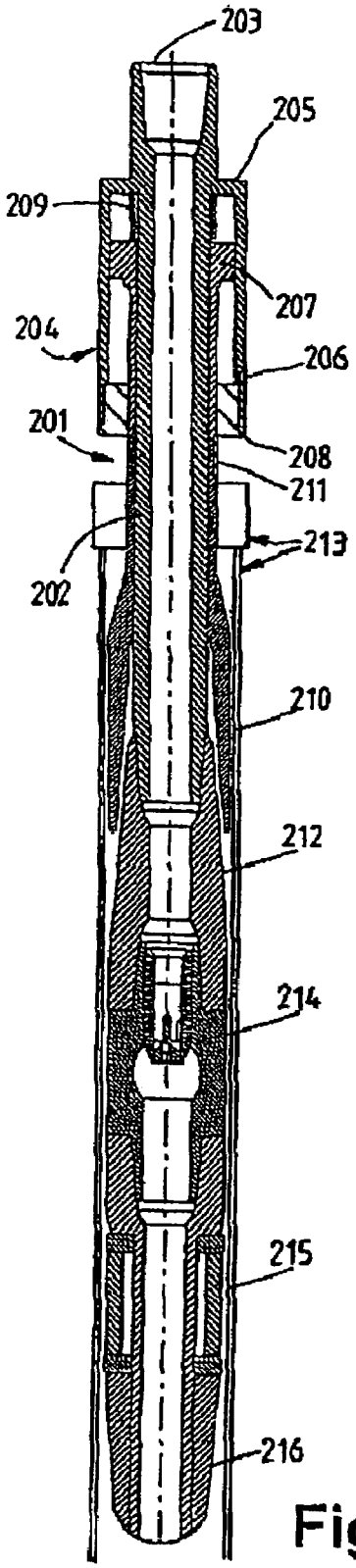
FIG. 4 shows a cross-sectional side view of a third embodiment of an apparatus in accordance with the present invention.
Figure 5:
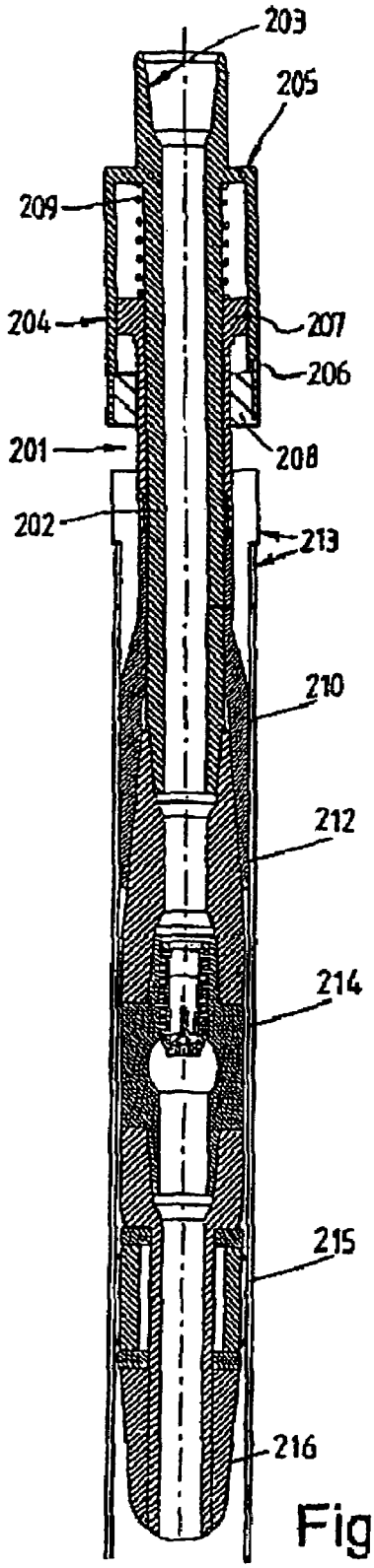
FIG. 5 shows a cross-sectional side view of the embodiment of FIG. 4 in use.

Referring to FIGS. 4 and 5 there is shown an apparatus in accordance with a third embodiment of the present invention which is generally identified by the reference numeral 201.

The apparatus comprises a cylindrical body 202 with a threaded connection 203 at the upper end for connection to a top drive. Attached to the cylindrical body 202, or machined into it, is a hydraulic cylinder 204, with threaded ports 205, 206 at opposite ends. These ports 205 and 206 permit hydraulic fluid to be injected under pressure to manipulate a hydraulic piston 207, secured within the cylinder by a threaded lock ring 208. A compression spring 209 is located in the cylinder 204 above the piston 207.

A grapple 210, provided with serrated teeth machined into its outer surface, is provided around the cylindrical body 202 below the hydraulic cylinder 204. The grapple 210 is connected to the hydraulic piston 207 by a threaded connection 211. A corresponding wedge lock 212 is provided on the cylindrical body 202. The grapple 210 and corresponding wedge lock 212 are located, in use, inside a casing 213. The piston 207 and lock ring 208 are fitted with seal rings (not shown) to prevent hydraulic fluid leakage.

A mud-check valve 214 is connected by a threaded connection at the lower end of the wedge lock 212. Below this valve is a rubber pack-off assembly 215. These prevent spillage of drilling fluid when the apparatus 201 is removed from within the casing joint 213. The pack-off 215 can be energized by either internal mud pressure or external mud flow.

In use, the apparatus 201 is lowered into the casing joint 213 as shown in FIG. 4. The grapple 210 is held out of contact with the wedge lock 212 by hydraulic fluid injected into port 206.

When the apparatus 201 is located at the correct installation depth within the casing 213, the pressure and fluid is released from port 206, and fluid is injected into port 205. This pushes the piston 207 downwards, pressing the grapple 210 against the wedge lock 212. The grapple 210 is forced outwards by the wedge lock 212, forming a mechanical friction grip against the inner wall of the casing 213. This is shown in FIG. 5.

The rig lifting equipment (not shown) raises the apparatus 201, and this causes the wedge lock 212 to be pulled upwards against the inner surface of the grapple 210, ensuring that constant outward pressure is applied to the grapple 210. The grip becomes tighter with increasing pull exerted by the rig lifting equipment.

Should hydraulic pressure be lost from port 205, the compression spring 209 ensures that the piston 207 continues to press the grapple 210 against the wedge lock 212, preventing release of the grapple from the wedge lock.

The apparatus 201 and casing 213 are then lowered into the well bore and the casing is secured. The apparatus 201 is lowered so that it supports its own weight only, and hydraulic fluid is then pumped out of port 205 and into port 206 to release the grapple 210 from the wedge lock 212 and thus release the apparatus 201 from the casing 213. The apparatus is then removed from the casing joint 213 and the process is repeated.

It is envisaged that the apparatus as described above could be used in conjunction with any of the apparatus and used with any of the methods as described in the co-pending International Applications based on GB Application Nos. 9818360.1, 9818363.5 and 9818366.8, entitled "An Apparatus for Facilitating the Connection of Tubular Using a Top Drive", "Method and Apparatus for Facilitating the Connection of Tubulars using a Top Drive," and "Method and Apparatus for facilitating the Connection of Tubulars using a Top Drive," respectively.

What is claimed is:

1. A method of connecting casing sections using a top drive, comprising:

closing a spider around a first casing section;

moving a second casing section into substantial axial alignment with the first casing section;

gripping the second casing section and supporting a weight of the second casing section using a gripper operatively coupled to the top drive;

rotating the second casing section using the top drive to join the second casing section to the first casing section to form a joint and a casing string;

compensating for the weight of the second casing section during rotation of the second casing section;

supporting the weight of the casing string using a drawworks; and opening the spider.

2. The method of claim 1, wherein the gripping comprises radially moving at least one gripping element of the gripper into engagement with a wall of the second casing section.

3. The method of claim 2, comprising moving the gripping element inward.

4. The method of claim 2, comprising moving the gripping element outward.

5. The method of claim 1, wherein compensating comprises adjusting at least one compensator.

6. The method of claim 5, comprising adjusting a compensator pressure.

7. The method of claim 6, wherein the compensator pressure is a pneumatic pressure or a hydraulic pressure.

8. The method of claim 1, wherein compensating comprises allowing downward movement of the second casing section while rotating the second casing section.

9. The method of claim 1, further comprising controlling the compensating remotely.

10. The method of claim 9, comprising controlling a compensator pressure.

11. The method of claim 1, further comprising flowing a fluid through a central passage of the gripper.

12. A top drive assembly for connecting casing sections, comprising:

a top drive;

a gripper having at least one gripping element and being operatively coupled to the top drive, the at least one gripping element for gripping a casing section and being movable between a non-gripping position and a gripping position; and at least one compensator comprising a first member and a second member, wherein the first member and the second member are relatively movable such that the at least one compensator has a variable length for compensating a weight of the casing section, wherein the at least one compensator is disposed between the top drive and the at least one gripping element.

13. The top drive assembly of claim 12, wherein the gripper comprises an upper part that is longitudinally movable relative to the top drive.

14. The top drive assembly of claim 13, wherein the upper part comprises a fluid passage.

15. The top drive assembly of claim 14, wherein the upper part is rotationally locked relative to an output shaft of the top drive.

16. The top drive assembly of claim 15, further comprising a splined connection operatively coupled between the upper part and the output shaft.

17. The top drive assembly of claim 16, wherein the splined connection comprises a splined connector attached to the output shaft and slidably connected to the upper part.

18. The top drive assembly of claim 12, wherein the at least one compensator is adjustable.

19. The top drive assembly of claim 18, wherein the at least one compensator comprises at least one piston and cylinder.

20. The top drive assembly of claim 19, wherein the at least one piston and cylinder are pneumatically operated.

21. The top drive assembly of claim 19, wherein the at least one piston and cylinder are hydraulically operated.

22. The top drive assembly of claim 18, wherein the at least one compensator comprises two pistons and two cylinders.

23. The top drive assembly of claim 12, further comprising a central fluid passage therethrough.

24. The top drive assembly of claim 12, wherein the at least one compensator is remotely controlled.

25. The top drive assembly of claim 12, wherein the at least one compensator comprises a bellows.

26. A method of connecting casing sections using a top drive, comprising:

coupling a gripper to the top drive for operation therewith, the gripper comprising at least one gripping element for gripping casing, wherein the gripping element is movable between a first position closer to an axis of the gripper and a second position further from an axis of the gripper;

closing a spider around a first casing;

moving a second casing to a well center;

gripping the second casing using the gripper;

compensating for a weight of the second casing using a compensator, whereby the gripper is moved axially relative to the top drive;

threading the second casing to the first casing, by rotating an output of the top drive, and correspondingly the gripper, to form a joint and a casing string;

opening the spider;

lowering the casing string through the spider;

closing the spider around the casing string; and disengaging the gripper from the casing string.

27. A method of connecting casing sections using a top drive, comprising:

operatively coupling a gripper to the top drive;

closing a spider around a first casing section;

positioning a second casing section above the first casing section;

gripping the second casing section and supporting a weight of the second casing section using the gripper;

compensating for the weight of the second casing section after gripping the second casing section;

rotating the second casing section using the top drive to join the second casing section to the first casing section to form a joint and a casing string; and opening the spider.

28. The method of claim 27, wherein gripping the second casing section comprises radially moving at least one gripping element of the gripper into engagement with a wall of the second casing section.

29. The method of claim 28, comprising moving the gripping element inward toward the wall.

30. The method of claim 28, comprising moving the gripping element outward toward the wall.

31. The method of claim 27, wherein compensating comprises adjusting at least one compensator.

32. The method of claim 31, further comprising adjusting a compensator pressure.

33. The method of claim 32, wherein the compensator pressure is a pneumatic pressure or a hydraulic pressure.

34. The method of claim 27, wherein compensating comprises allowing downward movement of the second casing section while rotating the second casing section.

35. The method of claim 34, wherein gripping the second casing section comprises radially moving at least one gripping element of the gripper into engagement with a wall of the second casing section.

36. The method of claim 35, wherein compensating comprises adjusting at least one compensator.

37. The method of claim 27, further comprising flowing a fluid through a central passage of the gripper.

38. The method of claim 27, further comprising controlling the compensating remotely.

39. The method of claim 38, comprising controlling a compensator pressure.

40. The method of claim 27, further comprising flowing a fluid through a central passage of the gripper.

41. The method of claim 27, wherein rotating the second casing section with the top drive comprises transferring to the second casing section through the gripper.

42. The method of claim 41, further comprising supporting a weight of the second casing section using the gripper.

43. A top drive assembly for connecting casing sections, comprising:

a top drive;

a gripper having at least one gripping element and being operatively coupled to the top drive, the at least one gripping element for gripping a casing section and being movable between a non-gripping position and a gripping position; and at least one compensator comprising a first member and a second member, wherein the first member and the second member are relatively movable such that the at least one compensator has a variable length for compensating a weight of the casing section, wherein the gripper comprises an upper part that is longitudinally movable relative to the top drive.

44. The top drive assembly of claim 43, wherein the upper part comprises a fluid passage.

45. The top drive assembly of claim 44, wherein the upper part is rotationally locked relative to an output shaft of the top drive.

46. The top drive assembly of claim 45, further comprising a splined connection operatively coupled between the upper part and the output shaft.

47. The top drive assembly of claim 46, wherein the splined connection comprises a splined connector attached to the output shaft and slidably connected to the upper part.

48. A top drive assembly for connecting casing sections, comprising:

a top drive;

a gripper having at least one gripping element and being operatively coupled to the top drive, the at least one gripping element for gripping a casing section and being movable between a non-gripping position and a gripping position;

at least one compensator comprising a first member and a second member, wherein the first member and the second member are relatively movable such that the at least one compensator has a variable length for compensating a weight of the casing section; and wherein the at least one compensator is adapted to move the at least one gripping element relative to the top drive.

49. The top drive of claim 48, wherein the at least one compensator is rotatable with the gripper.

50. The top drive of claim 48, further comprising a central fluid passage through the gripper.

51. The top drive of claim 48, wherein the first member is connected to the top drive and the second member is connected to the at least one gripping element.

52. The top drive of claim 48, wherein the at least one compensator comprises a bellow.

53. A top drive assembly for connecting casing sections, comprising:

a top drive;

a gripper having at least one gripping element and being operatively coupled to the top drive, the at least one gripping element for gripping a casing section and being movable between a non-gripping position and a gripping position; and at least one compensator comprising a first member and a second member, wherein the first member and the second member are relatively movable such that the at least one compensator has a variable length for compensating a weight of the casing section, and the first member is connected to the top drive and the second member is connected to the at least one gripping element.

* * * * *